US010708982B2

(12) United States Patent
Frank et al.

(10) Patent No.: US 10,708,982 B2
(45) Date of Patent: Jul. 7, 2020

(54) METHOD FOR OPERATING A HOB, AND HOB

(71) Applicant: E.G.O. Elektro-Geraetebau GmbH, Oberderdingen (DE)

(72) Inventors: Marcus Frank, Oberderdingen (DE); Achim Lauser, Wimsheim (DE); Matthias Weigold, Bretten (DE)

(73) Assignee: E.G.O. Elektro-Geraetebau GmbH, Oberderdingen (DE)

( * ) Notice: Subject to any disclaimer, the term of this patent is extended or adjusted under 35 U.S.C. 154(b) by 416 days.

(21) Appl. No.: 15/641,639

(22) Filed: Jul. 5, 2017

(65) Prior Publication Data

US 2018/0014363 A1 Jan. 11, 2018

(30) Foreign Application Priority Data

Jul. 6, 2016 (DE) ..... 10 2016 212 330

(51) Int. Cl.
*H05B 6/06* (2006.01)
*F24C 7/08* (2006.01)
*H05B 6/12* (2006.01)

(52) U.S. Cl.
CPC ..... *H05B 6/062* (2013.01); *F24C 7/083* (2013.01); *F24C 7/087* (2013.01); *H05B 6/12* (2013.01)

(58) Field of Classification Search
CPC ... H05B 6/04; H05B 6/06; H05B 6/12; H05B 6/062; H05B 6/065; H05B 2213/07
USPC ..... 219/620, 621, 626, 627, 633, 660, 661, 219/667, 675
See application file for complete search history.

(56) References Cited

U.S. PATENT DOCUMENTS 9,451,657 B2 9/2016 Schilling et al.
2010/0181302 A1 7/2010 Ernst et al.
2011/0120989 A1* 5/2011 Schilling ..... H05B 6/062 219/661

(Continued)

FOREIGN PATENT DOCUMENTS

DE 10141754 A1 4/2003
DE 10253198 A1 6/2004
DE 102004016631 A1 11/2005

(Continued)

OTHER PUBLICATIONS

European Patent Office, Extended European Search Report for Application No. 17177450.8, dated Dec. 6, 2017, 8 pages, Germany.

*Primary Examiner* — Phuong T Nguyen
(74) *Attorney, Agent, or Firm* — Alston & Bird LLP

(57) ABSTRACT

A method for operating a hob for maintaining a state, which exists at the time of activation of the maintaining operation, at a cooking point of the hob with a cooking vessel on it detects a change in temperature of the cooking vessel as a change in state, wherein supplied power and/or a change in temperature of the cooking vessel are evaluated. A maintaining function for maintaining the state, which is indicated at this time, at the cooking point with a cooking vessel placed on it can be triggered. In doing so, the current state at the cooking point is classified as a process at the boiling point of water on the one hand and as a process which is different therefrom or as a process which takes place at a different temperature without a phase transition of water on the other hand.

16 Claims, 2 Drawing Sheets

(56) References Cited

U.S. PATENT DOCUMENTS

2013/0075388 A1 3/2013 Schilling et al.

FOREIGN PATENT DOCUMENTS

| | | | |
|---|---|---|---|
| DE | 102008008604 | A1 | 8/2009 |
| DE | 102011083383 | A1 | 3/2013 |
| DE | 102013108646 | A1 | 2/2015 |
| EP | 1732357 | A2 | 12/2006 |
| EP | 2330866 | A2 | 6/2011 |
| EP | 2574143 | A2 | 3/2013 |
| EP | 2945463 | A1 | 11/2015 |
| WO | WO 2008/148529 | A1 | 12/2008 |
| WO | WO 2009/016124 | A1 | 2/2009 |

* cited by examiner

METHOD FOR OPERATING A HOB, AND HOB

CROSS-REFERENCE TO RELATED APPLICATIONS

This application claims priority to German Application No. 10 2016 212 330.0, filed Jul. 6, 2016, the contents of which are hereby incorporated herein in its entirety by reference.

TECHNOLOGICAL FIELD

The invention relates to a method for operating a hob, in which method a state which exists at the time of activation is intended to be able to be maintained, in particular because an operator has triggered a corresponding maintaining function. This is advantageous particularly when the state which is indicated at this time is considered by the operator to be desired or advantageous for continued boiling or a further operation of the hob for this cooking vessel. Furthermore, the invention relates to a hob which is designed to carry out this method.

BACKGROUND

US 2011/120989 A1 discloses how, in the case of an inductively heated cooking point with a cooking vessel on it, changes in temperature at the cooking vessel can be identified. To this end, it is not necessary for a precise absolute temperature to be known or a precise absolute temperature is not ascertained since the focus is only on changes in temperature or only changes in temperature can be detected.

BRIEF SUMMARY

The invention is based on the problem of providing a method, as mentioned at the outset, for operating a hob and a hob as mentioned at the outset, with which method and hob an option, which can be advantageously employed by an operator, for maintaining a state, which is indicated at a specific time, at an inductively heated cooking point of a hob with a cooking vessel on it is possible, wherein, in the case of the hob, it is preferably also intended to be possible to react to different conditions or states or changes in state with the method.

This problem is solved by a method and by a hob. Advantageous and preferred refinements of the invention are the subject matter of the further claims and will be explained in more detail in the text which follows. In doing so, some of the features will be explained only for the method or only for the hob. However, irrespective of this, they are intended to be able to apply both to the method and to the hob on their own and independently of one another. The wording of the claims is incorporated in the present description by express reference.

It is provided that a hob with a cooking point is operated in accordance with requirements, wherein, in doing so, a cooking vessel is put into place and is simply heated, advantageously is inductively heated. A specific power level has been prespecified either by a cooking programme or advantageously by an operator, and the cooking vessel is heated or remains hot. In this case, the cooking vessel is preferably filled or contains something, for example water or similar liquid or a solid product being cooked, such as a steak or the like. In this case, a change in temperature of the cooking vessel is detected as a change in state, preferably using a method known according to US 2011/120989 A1 as mentioned at the outset, that is to say in particular by way of an inductively heated cooking point. It is therefore advantageously possible that the measurement variable which is correlated to the cooking vessel temperature is the period duration of the resonant circuit of this cooking point and/or another variable is derived from this.

Primarily at the beginning of the operation of the hob, it can be assumed that the temperature will still increase, generally starting from room temperature. A heating process of the cooking vessel can be detected, advantageously can be detected from the start. This is particularly advantageously performed by means of a control means of the hob. In a similar way, the power which is supplied to the heating device or to the cooking vessel and/or a change in temperature of the cooking vessel can be detected and evaluated, in particular when these detected variables are still changing. This can also apply to the profile of power and/or change in temperature of the cooking vessel with respect to time. Here, the term "detection" is intended to be understood to mean the same as "observe".

An operator can trigger a maintaining function at any time, as a result of which the state, which is indicated at this time, at the cooking point with a cooking vessel placed on it is intended to be maintained. In practice, this is relevant, for example, when, at rather low temperatures, a sauce in the cooking vessel is simmering or lightly boiling with a visual appearance that appears appropriate to and desired by the operator. That is to say it is not intended to be bubbling hot. A further exemplary situation is boiling water in the cooking vessel with or without a product to be cooked therein. By way of example, when boiling potatoes or pasta, boiling with the formation of bubbles is usually desired, but excessive formation of bubbles with the resulting splashing of water is usually intended to be avoided. This is a special process at the boiling point of water.

A further example is searing of meat in a pan as a cooking vessel at temperatures of usually above 200° C. when, for example, fat which is introduced into the pan exhibits a behavior which appears to the operator to correspond to the desired temperature. Therefore, the meat in the pan is intended to be prepared or seared at this temperature or in this state.

In all of the abovementioned cases, it is desirable when the operator can maintain or, as it were, freeze this state, without taking into consideration the power level required or the temperature which is set in the process for this purpose. This is intended to be provided by the so-called hold function.

According to the invention, the current state at the cooking point is classified as a process at the boiling point of water, that is to say in particular when water or a similar liquid is boiling, on the one hand. On the other hand, the current state is classified as a process which is different therefrom and takes place at a different temperature and primarily without a phase transition of water in the cooking vessel, wherein this can take place both at temperatures of below 100° C. and also considerably above 100° C. A process of this kind could be carried out even at 100° C. as a second case when no water is involved, that is to say for example searing at this temperature.

In the first-mentioned case in which there is preferably a largely constant temperature at the cooking vessel directly before triggering of the heating function, a process at the boiling point of water is identified since, as is known, the temperature at the boiling point of water is relatively constant and relatively precisely 100° C. As an alternative to a largely constant temperature at the cooking vessel directly before triggering of the maintaining function, the temperature can also increase slightly or drop slightly, for example by 1° C. to 5° C. Since the operator has already visually identified boiling of water in this case, boiling therefore has to already be present and, owing to the largely constant temperature at the cooking vessel, this can be identified from the hob. The power supply or a power supply per unit area at this point is then intended to be kept largely constant since it has ultimately not only led to boiling of water in the cooking vessel but rather also to a desired appearance. As an alternative, a customary power density for continued boiling of water can be set, for example between 2 $W/cm^2$ and 4 $W/cm^2$.

In the second case, in the case of a process with a temperature not at or different from the boiling point of water, the process is regulated at a largely constant temperature of the cooking vessel by adapting the power supply, specifically at the temperature which prevails at the time of triggering of the maintaining function or the process is regulated at this temperature, without this temperature being able to be detected as an absolute value per se, by preventing a change in temperature. Therefore, the temperature is kept constant. This is known from the method according to US 2011/120989 A1 mentioned above.

When a decision is made in the first case, the process is therefore regulated at a constant power supply or power supply per unit area; in the second case, the process is regulated at a constant temperature. This is because, when a decision is made in the second case, it is assumed that different changes in temperature can be regulated out at temperatures different from 100° C., that is to say in a process not at the boiling point, and therefore a temperature can be kept constant by changing the power supply, as is necessary. Indeed, this is not possible in the first case directly at the boiling point of water since no change in temperature would be able to be established in the case of an increased power supply or power supply per unit area, the 100° C. cannot be exceeded. Furthermore, it is assumed that, in the second case, there is a cooking impression which prevails on account of a specific temperature, and the cooking impression is identified, and the operator would like to maintain this cooking impression, independently of a power supply or power supply per unit area required for this purpose.

In an advantageous refinement of the invention, it is possible that a size of the cooking vessel which has been put into place is determined on the basis of a size, which is known in the hob, of the cooking point or the heating device of the cooking point on which the cooking vessel is placed. In the case of known discrete heating devices or induction heating coils as heating devices, the diameters and therefore surface areas thereof are known, so that the supplied power per unit area can also be determined on the basis of a known supplied power. As an alternative, in the case of a hob with a large number of relatively small heating devices or induction heating coils which are then operated together in order to form one cooking point for a cooking vessel, wherein a cooking vessel usually covers three to seven or nine heating devices, a size of the cooking vessel can likewise be determined on the basis of the degree of coverage of the heating devices. This is known, for example, from EP 2945463 A1 and WO 2009/016124 A1. A power supply per unit area can then once again be determined therefrom on the basis of the sum of the power supplied to the heating devices.

In a further refinement of the invention, according to US 2011/120989 A1 as mentioned at the outset, a change in temperature of the cooking vessel can be detected from operating parameters for the inductive heating device. This forms the basis of a temperature control process according to the second case.

In one refinement of the invention, the maintaining function can be maintained until an operator either turns it off or else deliberately and intentionally changes a power at this cooking point or for this cooking vessel. As an alternative, it can be provided that the maintaining function is stopped on its own, that is to say automatically, after a certain time. This time can be prespecified as an absolute time, for example 30 minutes to 60 minutes or even 90 minutes. As an alternative, the maximum period until automatic switch-off can depend on the level of an estimated temperature at the cooking point, which can be estimated by means of a level of a power supply or primarily a power supply per unit area. In this case, the higher the power supply per unit area or the higher an estimated temperature, the lower the maximum run time should be.

In a further refinement of the invention, it can be provided that a sudden drop in temperature is established after triggering of the maintaining function, in particular within two to ten or even 20 seconds. In practice, this can be triggered by insertion of relatively cool product to be cooked or product to be fried into the cooking vessel, ultimately even by addition of water or similar liquids with boiling temperatures close to that of water.

If a sudden drop in temperature of this kind is established, it can be provided in one refinement of the invention that the heating device or the hob or its control means attempts to increase the temperature again in the two cases mentioned at the outset. In the case of operation with a largely constant power supply or power supply per unit area, this is performed in any case since the introduced product to be cooked or the liquid is also heated, this simply leading to a renewed increase in the temperature. Ultimately, the cooking process should most likely continue. Owing to the constant power supply or power supply per unit area, this will generally last somewhat longer. In the abovementioned case of regulation at a constant temperature of the cooking vessel, the power or power per unit area is increased or even considerably increased for more rapid compensation of the drop in temperature or the change in temperature, preferably by 30% to 100% or even 200%. In doing so, the case which in principle prevailed up until that point should continue to be maintained, that is to say, during the compensation of the drop in temperature and also thereafter, heating should further be continued either at a constant power supply or regulation at a previously prevailing constant temperature should be performed.

In this case, the duration and/or steepness can advantageously also be detected starting from the sudden drop in temperature until the compensation of the drop in temperature or the change in temperature. This duration and/or steepness can be used to identify what the drop in temperature has triggered. For example, in one refinement of the invention, the sudden drop in temperature with a duration of less than 10 seconds until compensation is evaluated as the introduction of a product to be fried or product to be cooked into the cooking vessel. The cooking vessel is then simply further heated at the previous temperature or the temperature which has now also been reached again. This applies both for liquid products to be cooked and for solid products to be fried or cooked. The previously prevailing state in the cooking vessel should, as has been explained above, be maintained in accordance with the wishes of the operator here.

If, for example, it takes more than 10 seconds until compensation, the sudden drop in temperature is evaluated as the introduction of water or a liquid product to be cooked with a similar boiling temperature into the cooking vessel. Specifically, a relatively large quantity of a product to be cooked will then usually have been introduced into the cooking vessel, it generally being possible for this to simply be only water or a corresponding liquid. Therefore, the cooking vessel continues to be heated at the previous power density or power density per unit area or at a customary power density per unit area for continued boiling of water. However, as an alternative, the process can also be regulated at the previous temperature value which then prevails as the setpoint temperature again.

However, it is important here that, after evaluation which is performed depending on the duration of compensation of the drop in temperature, the fundamental method during the maintaining function can also change. In particular, a changeover can be made from a previous regulation at a constant temperature which is not the boiling point of water according to the second case to a corresponding constant power supply in order to simply continue a cooking process at the boiling point of water with a constant power supply or power supply per unit area. This applies particularly when previously a frying process at temperatures far above 100° C., in particular above 200° C., in which, for example, seared meat is quenched with liquid was highly likely on account of a high power supply or power supply per unit area. The meat in the liquid is then usually intended to be brought to the boil or at least simmered again.

Particularly in the case of measurement systems in which the magnetic properties of the cooking vessel are used as a measurement variable for the temperature, it may be found that a change in signal of the hob control means initially appears as a change in temperature, wherein, however, it concerns another influence in reality. A displacement of the cooking vessel can be particularly mentioned here. In the event of displacement, the coverage per unit area of the cooking vessel over an induction heating coil changes, and therefore the measured inductance changes, similarly to if the permeability of the cooking vessel were to change for temperature-related reasons. In order to realize a reliable function, this effect has to be distinguished from actual changes in temperature. In a further refinement of the invention, it can therefore be provided that, in the case of a duration of a change in signal or change in temperature of less than 5 seconds, merely displacement of the cooking vessel on the hob is identified and not an actual change in temperature at the cooking vessel. This is therefore not considered to be a control deviation. In this case, it is possible that the change in signal is ignored and the newly set value is used as the new control value.

In a further refinement of the invention, it is possible that a gradient of the change in signal or change in temperature is additionally evaluated after the sudden drop in temperature. In the abovementioned case of the introduction of water into the cooking vessel, this slope will, after a few seconds, increase more slowly than in the case of introduction of a product to be fried or a product to be cooked into the cooking vessel.

After the introduction of additional water into the cooking vessel is identified, the temperature profile is further monitored. This introduction of additional water can be identified when the temperature profile is constant by the boiling point of water having been reached after the compensation of the drop in temperature. This can be identified in any case by a constant temperature which is set.

If a process with a temperature at the boiling point of water is identified, a constant power or power per unit area, which can advantageously lie between 0.5 W/cm$^2$ and 5 W/cm$^2$, can be supplied to the heating device. Boiling of water is achieved primarily between 2 W/cm$^2$ and 4 W/cm$^2$ with a high degree of reliability. A higher power supply or power supply per unit area is possible, but generally not necessary in order to keep water on the boil. Instead, only an unnecessarily large amount of energy would be consumed, and additionally excessive boiling of water could be caused, this then being considered to be disruptive on account of the excessive formation of bubbles and splashing water.

The physical measurement variable in this invention is advantageously the period duration (Per) of the resonant circuit comprising the induction coil when the resonant circuit is excited for measurement purposes and decays freely, see US 2011/120989 A1. The period duration changes due to a change in permeability of the cooking vessel as the temperature (T) increases. Therefore, Per=f(T).

However, at the same time, the period duration is also determined by the position of the cooking vessel. If, starting from a concentric placement of a round cooking vessel on a round induction coil with a similar diameter, the cooking vessel is pushed toward the outside, the period duration likewise changes. The measurement signal is therefore also dependent on an eccentricity (e) of the cooking vessel with respect to the coil. Therefore, Per=f(e).

If a temperature control operation is now intended to be established by measuring the period signal, there is the challenge that this measurement variable is dependent not only on the temperature of the cooking vessel itself, but also on the position of the cooking vessel Per=f(T, e). However, it is entirely customary for the user to displace the cooking vessel during a cooking/frying process. Therefore, a method has to be found in order to distinguish between a change in signal due to displacement of the vessel and an actual change in temperature.

In one possible method, in processes at the boiling point, boiling-dry can be identified when water no longer covers the pot base and as a result the pot base is warmer than when it is covered with water. This can be suitably indicated to an operator, advantageously acoustically and/or optically, and/or the power output can be reduced or stopped.

In one possible further method, during the maintaining process, an operator can have the option of adapting or finely adjusting the actual level of the maintained temperature once again. When this fine adaptation is performed, the setpoint temperature can be adapted in the event of a temperature control operation and/or the set power density per unit area can be adapted in the case of water at the boiling point.

It can be provided that an operator can interrupt the maintaining process and can later restart the maintaining process or can select other, power-controlled power densities per unit area in the meantime. Therefore, it is possible to again return to a power density per unit area which was previously once set with a maintaining function during a maintaining process, for example by a corresponding operator control action on an operator control element even after a few minutes.

These and further features are evident not only from the claims but also from the description and the drawings, the individual features each being implementable by themselves or severally in the form of subcombinations for an embodiment of the invention and in different fields and being able to be advantageous and independent protectable embodiments for which protection is claimed here. The subdivision of the application into individual sections and subheadings does not limit the general validity of the statements made thereunder.

BRIEF DESCRIPTION OF THE SEVERAL VIEWS OF THE DRAWINGS

Exemplary embodiments of the invention are schematically illustrated in the drawings and are explained in more detail in the text which follows. In the drawings.

DETAILED DESCRIPTION

Figure 1:
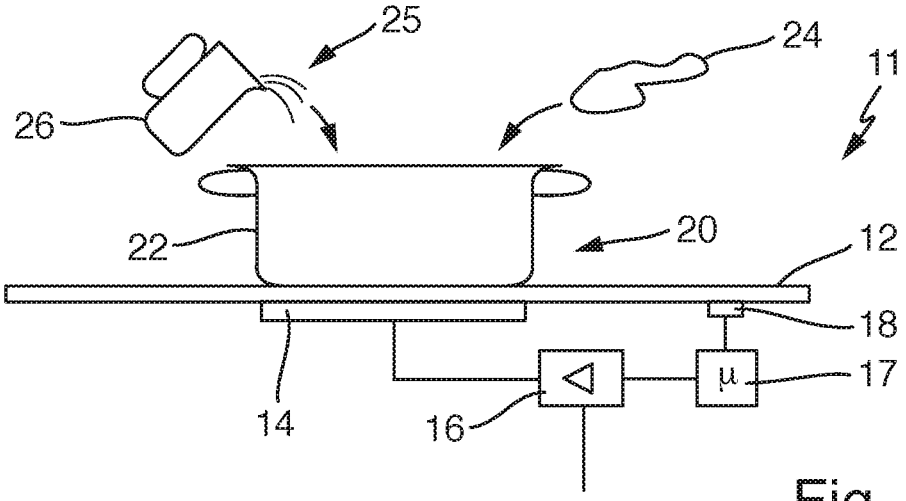
FIG. 1 shows a highly schematic illustration of a hob with which the method according to the invention can be carried out.

FIG. 1 highly schematically illustrates a hob 11 in the form of an induction hob which is designed to carry out the method according to the invention. The hob 11 has a hob plate 12 and an induction coil 14 which is arranged beneath the hob plate. A power electronics system 16 for the induction coil 14 is driven by a control means 17 for the purpose of setting a power supply or power supply per unit area. The control means 17 is further connected to an operator control element 18 of the hob 11, illustrated here by a capacitive sensor element beneath the hob plate 12.

The induction coil 14 defines, as it were, a cooking point 20 on the hob 11, on which cooking point a cooking vessel 22 is positioned. Here, the cooking vessel is illustrated as a cooking pot, wherein frying can also be performed in a cooking pot. It goes without saying that, as an alternative, the cooking vessel can be a considerably taller cooking pot or a considerably shorter pan. Items which may be added to the cooking vessel 22 are also illustrated. A piece of meat 24 which may be intended to be seared in the cooking vessel is illustrated on the right-hand side. The addition of water 25 into the cooking vessel 22 using a vessel 26 is illustrated on the left-hand side.

Instead of a single induction coil 14, a cooking point 20 can also be formed from a plurality of induction coils, for example two to four or even more, depending on the size of the cooking vessel 22. Induction coils of this kind are disclosed, for example, in EP 2945463 A1 and WO 2009/016124 A1. However, a plurality of these induction coils are then operated as a single common induction coil, advantageously with a uniform power density per unit area for the base of the cooking vessel 22, so that they can be considered to be a single induction coil here. All of the induction coils of a cooking point, and not just a single induction coil, are then simply taken into consideration for the abovementioned temperature control operation.

According to US 2011/120989 A1 mentioned above, the control means 17 can, owing to the connection to the power electronics system 16 and the induction coil 14, identify a change in temperature from operating parameters of the induction coil 14. Express reference is made to US 2011/120989 A1 for the details.

Figure 2:
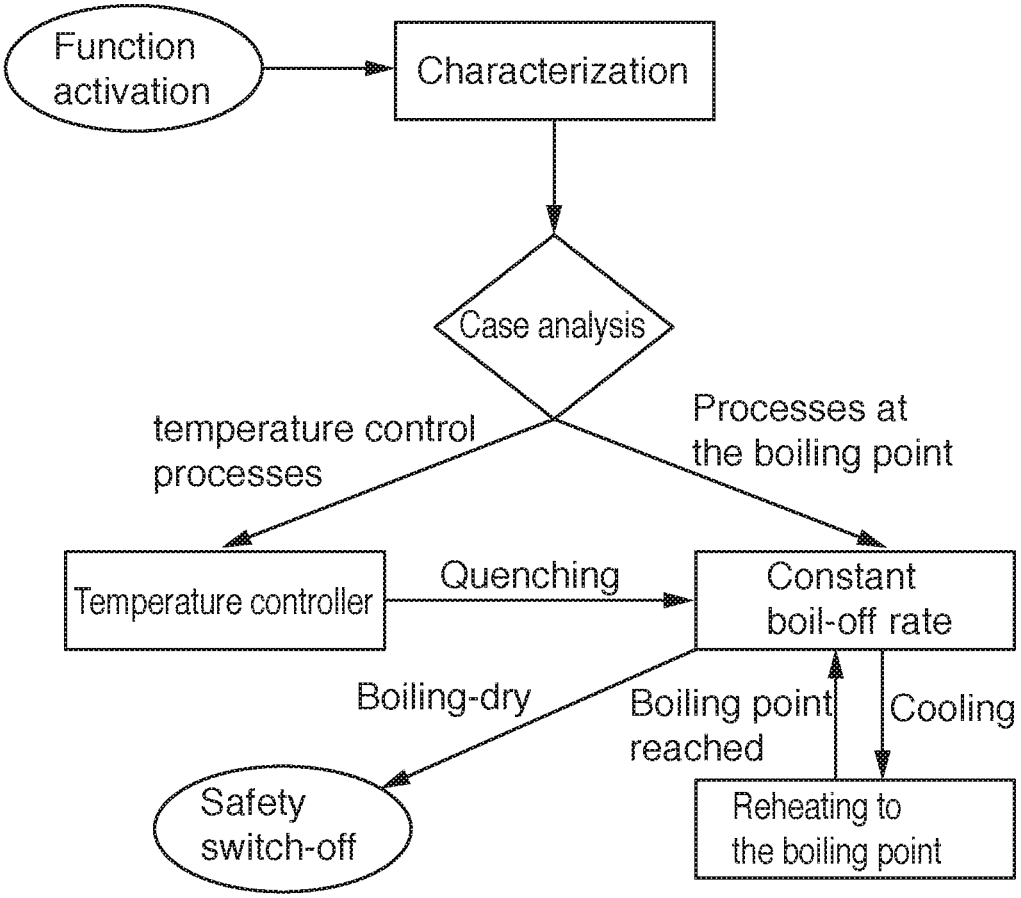
FIG. 2 shows a possible functional sequence for illustrating the method according to the invention.

The functional diagram in FIG. 2 schematically illustrates how the method according to the invention can proceed. At the beginning of a process of placing the cooking vessel 22 with unknown contents onto the cooking point 20 and beginning the heating operation, the power supply or power supply per unit area at the induction coil 14 are already detected by the control means 17 by means of the power electronics system 16. The power supply per unit area can be calculated from a power supply, which flows across the power electronics system 16, from a geometric size, which is known to the control means 17, of the induction coil 14. If the maintaining function is then activated as function activation at a specific time, an attempt has to be made to classify the current state depending on the process at the boiling point of water on the one hand and the process at a different temperature on the other hand, that is to say a kind of characterization. This leads simply to case analysis.

In the case of function activation of the maintaining function on account of the presence of a state in which a largely constant temperature can be identified at the cooking vessel 22 without much control having to be performed, it can be concluded during the characterization that a process at the boiling point of water is present. To this end, the control means 17 can, for example, also evaluate different additional factors, which are not illustrated here, such as the level of the current power supply per unit area for example. In order to maintain a process at the boiling point of water, that is to say in order to bring water to the boil and to maintain boiling, a power supply per unit area of between 0.5 $W/cm^2$ and 6 $W/cm^2$ is usually required. If the current power supply per unit area is considerably above the range or considerably below the range, there may be a fault and the maintaining function may then no longer be activated under certain circumstances. If, however, a plausibility check of this kind reveals that a process at the boiling point can by all means be present, a state with a constant boil-off rate is present, specifically boiling of the water. The further steps are explained in more detail below.

If, however, the characterization and the case analysis reveal that a process at the boiling point of water is not taking place, but rather a so-called temperature control process because the temperature control therefore has to intervene in order to compensate for slightly fluctuating temperatures, a temperature controller will commence operation after activation of the maintaining function. This means that the control means 17 then simply attempts to control the power supply or power supply per unit area by means of the power electronics system 16 such that the temperature prevailing at the time of function activation of the maintaining function is further maintained. Therefore, temperature deviations are regulated out. In both cases, this can then be continued as a maintained state for a relatively long time or an unspecified duration. Certain maximum durations after which the method is stopped can be provided as a safety function since ultimately a kind of automatic cooking programme takes place and therefore an operator could possibly forget that the hob 11 is switched on. For example, a considerable reduction in the power supply per unit area, for example to 10% to 30% or 50%, can take place after 30, 60 or 90 minutes. As an alternative, the power supply per unit area can be completely switched off after this time has elapsed. Before a reduction or switch-off, an operator can be provided with optical and/or acoustic notification, but this does not necessarily have to be the case.

Figure 3:
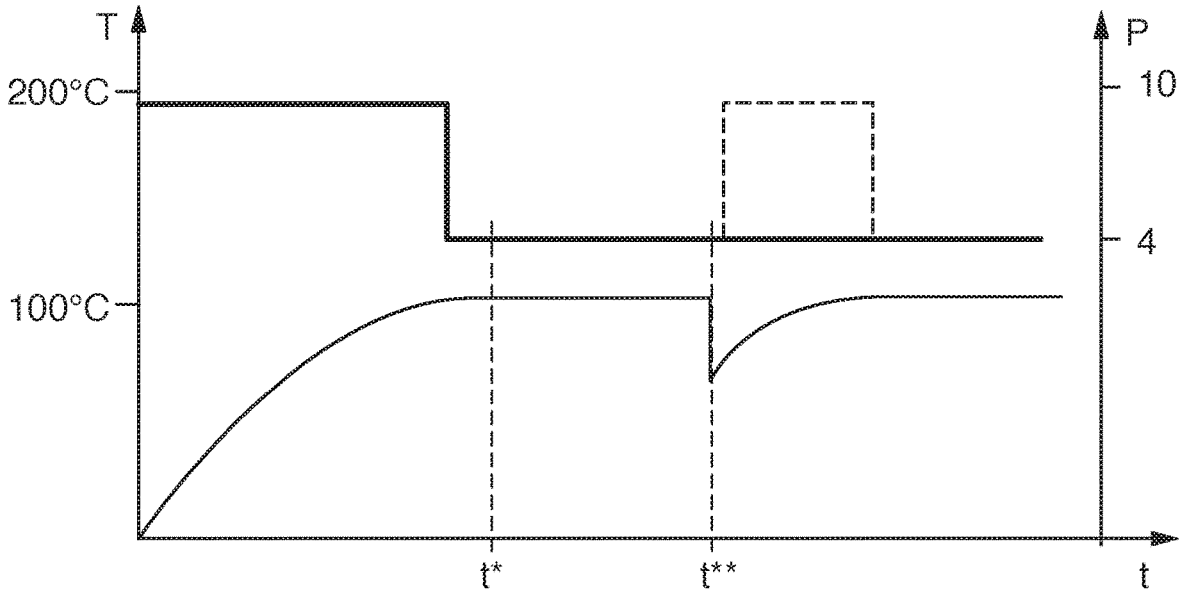
FIGS. 3 and 4 show different profiles for temperature and power supply per unit area in the case of different heating processes or states at the hob in accordance with FIG. 1.

In FIG. 3, for the first case, the behavior with respect to time for the temperature T is illustrated on the left-hand side Y axis and the power supply per unit area P is illustrated on the right-hand side Y axis, wherein primarily the power supply per unit area P is not illustrated in a linear manner. The temperature T increases, specifically relatively slowly, because water is heated in the cooking vessel 22 and therefore initially a large amount of energy has to be introduced for an increase in temperature. At a temperature of 100° C., the water in the cooking vessel 22 boils, in response to which the temperature T becomes constant. The maintaining function is activated at a specific time t*, that is to say when the operator takes the view that precisely this state with boiling water and also this degree of boiling should be continued. The temperature T remains constant starting from this point. A power supply per unit area may first have been somewhat higher at the start, as is illustrated by the thick line, at for example 10 W/cm$^2$. It may then have been somewhat reduced by an operator before the time t*, for example because the water in the cooking vessel 22 had boiled excessively, for example at 4 W/cm$^2$. If a desired cooking impression has then been established in the case of the second somewhat lower power supply per unit area, the maintaining function is activated. Further continued cooking is performed at the power supply per unit area of the time t*. This is also illustrated in FIG. 3.

If the case of a sudden drop in temperature as mentioned at the outset now occurs, for example to a temperature of approximately 60° C. here, the temperature T falls and the power supply per unit area is initially maintained. Since the control means 17 then sees that the temperature T is increasing only slowly, it is clear that a relatively large quantity of additional product to be cooked, in particular additional water 25 according to FIG. 1, has been introduced into the cooking vessel 22. The process can then either continue to be heated with the power supply per unit area P as at time t* until the water in the cooking vessel 22 comes to the boil again and the temperature T=100° C. is reached again with a cooking impression which will then have again largely approximated the previous one from time t*. This constant power supply per unit area is illustrated at 4 W/cm$^2$. As an alternative, the power supply per unit area can be increased at least until a constant temperature T has been established again, for example increased to the power supply per unit area used at the beginning of the heating process, here 10 W/cm$^2$. This is illustrated using dashed lines. If a constant temperature T is then established, a change can again be made to the previous power supply per unit area at time t*. The brief increase in the power supply per unit area is then used to more rapidly reach the temperature T=100° C. again. This is illustrated at the bottom right in FIG. 2 with the case of cooling as a sudden drop in temperature and reheating until the boiling point has been reached again.

If the control means 17 establishes that a signal drop takes place suddenly and possibly even in steps, for example within a few seconds, it can be concluded that the cooking vessel 22 on the hob 11 has been displaced, for example by 0.5 cm to 3 cm. As an alternative, the cooking vessel can also have been briefly removed from the cooking point 20 and then placed on it again. In this case, the control means 17 can advantageously maintain the power supply per unit area from time t* and a brief increase is not required.

Figure 4:
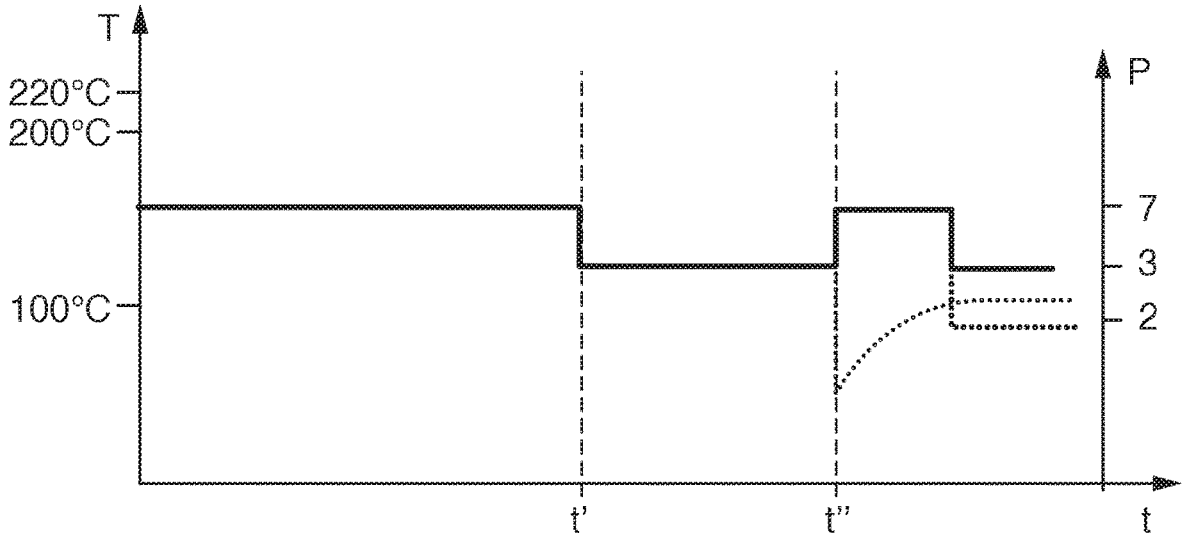

FIG. 4 illustrates what the profiles for the temperature T and the power supply per unit area P with respect to time look like in a second case with desired searing of meat 24 in the cooking vessel 22. An operator will highly heat the cooking vessel 22 with a customarily high power supply per unit area if searing of, for example, steak is required. In this case, only a small amount of oil or fat is expected to be contained in a pan as cooking vessel 22, and therefore the cooking vessel does not have to be heated to a great extent. The temperature T increases continuously to a certain extent. A temperature which is considered by an operator to be good and sufficient to fry a steak as required, usually somewhat above 220° C., is reached at time t'. Therefore, the maintaining function is operated at time t' here. Since the control means 17 has established a further change in temperature of the cooking vessel 22 by means of the power electronics system 16 at this time, the control means therefore knows that a process at the boiling point of water cannot take place, as has been explained previously. Therefore, temperature control is performed in accordance with the case analysis at this time and the temperature of time t' is kept constant from now on. Even though, at first glance, the process appears to be very similar to that from FIG. 3 with the constant power supply per unit area of the first case, the cause is different in each case. In FIG. 3, the temperature is, owing to the boiling of water in the cooking vessel 22, necessarily kept at 100° C. as long as no quenching or the like takes place. In the case of FIG. 4, a first temperature control operation to the value established at time t' is actually carried out.

If a sudden drop in temperature is established at time t", the temperature control operation which is just carried out in any case attempts to compensate for this drop in temperature again and to return to the temperature of time t' as quickly as possible. Whereas a very high or, under certain circumstances, even the maximum power density per unit area, for example 7 W/cm$^2$, was selected at the beginning of the heating process, a lower power density per unit area has been used after t', which lower power density per unit area is simply selected so as to maintain this temperature. The lower power density per unit area is, for example, 3 W/cm$^2$. In order to compensate for the sudden drop in temperature at time t", the power density per unit area can once again be increased and, in particular, be set at the maximum again. As soon as the sudden drop in temperature is then regulated-out again and the temperature at time t' has been reached again, the temperature control means also reduces the power density per unit area again, as is illustrated here. The control behavior of the temperature controller can be designed, for example, as illustrated here, as a two-point controller. However, in an advantageous refinement, a continuous controller is used which sets the power requirement proportional to the temperature deviation from the controller setpoint value, or even can additionally be set depending on the derivative and/or integral thereof. Controllers of this kind, for example P, PI, PD or PID controllers, are known to a person skilled in the art.

If the temperature controller or the control means 17 establishes that the sudden drop in temperature takes place to a considerably lower temperature than that at time t' and possibly a temperature increase takes place very quickly, for example within 15 seconds, a process of an abovementioned quenching of a seared piece of meat or steak can be identified. This is illustrated by the dotted temperature profile. A certain quantity of liquid is therefore added to the seared meat. The operation of the control means 17, as is also shown in FIG. 2, then changes from the case of constant temperature control to the case of a constant power density per unit area. Usually, specifically after quenching of seared meat in order to produce a sauce for example, the sauce is brought to a light boil or simmer. However, it should certainly not be bubbling hot. For this reason, a temperature of T=100° C. can then not be exceeded after reheating, the introduced liquid prevents this. Therefore, a change should now be made to a constant boil-off rate or a constant power density per unit area. However, this is not actually known to the control means 17 since the power density per unit area at time t' was too high and has led to a temperature of 220° C. or has maintained this. Here, after a constant temperature is reached, in the present case specifically of approximately 100° C., a change can then be made to a freely selected fixed value for the power supply per unit area. The value can lie between 0.5 W/cm$^2$ and 5 W/cm$^2$, as mentioned at the outset, for example at 2 W/cm$^2$ or 3 W/cm$^2$, here at 2 W/cm$^2$ illustrated with a dotted line. Here, the control means 17 can also further incorporate the size of the power density per unit area at time t' in order to be able to approximately estimate therefrom whether a process is proceeding at rather high temperatures or rather relatively low temperatures. The starting gradient of the temperature after time t" can also be taken into account.

Finally, FIG. 2 further illustrates that, starting from a case of a constant power density per unit area, the water in the cooking vessel 22 has boiled away, that is to say a case of boiling-dry is present. When the temperature then begins to rise again, specifically a safety switch-off can intervene in order to prevent damage to or burning of the rest of the products being cooked or food in the cooking vessel 22.

In the second case of regulation at a constant temperature, this case cannot be as easily identified since it is simply regulated at a constant temperature. However, it is possible to identify whether a lower or considerably lower power density per unit area is required in order to reach the constant temperature starting from a specific time. This could also be identified as a case of boiling-dry with a resulting safety switch-off.

That which is claimed:

1. A method for operating a hob for maintaining a state at a cooking point of the hob with a cooking vessel on said cooking point, wherein said state exists at the time of activation of an operation for maintaining, the method comprising:

placing said cooking vessel onto said cooking point of said hob and being heated by said cooking point or by an inductive heating device of said cooking point according to requirements;

detecting a change in temperature of said cooking vessel as a change in state;

detecting a heating process of said cooking vessel and evaluation of supplied power or a temperature of said cooking vessel or a profile thereof with respect to time;

triggering of a maintaining function by an operator for maintaining said state, which is indicated at said time, at said cooking point with said cooking vessel placed on it; and dividing a current state at said cooking point firstly into a process at a boiling point of water and secondly into a process which is different therefrom or into a process which takes place at a different temperature without a phase transition of water, wherein, in a case of a decision in favor of said process at said boiling point of water, said power supply at said point is then kept largely constant or a customary power supply for continued boiling is set, and wherein, in a case of a decision in favor of said process not at said boiling point of water, said process is regulated at a constant temperature of said cooking vessel by adapting said power supply.

2. The method according to claim 1, wherein a size of said cooking vessel is determined, which size has been put into place, on a basis of a size, which is known in said hob, of said cooking point which is operated for said cooking vessel or a heating device of said cooking point.

3. The method according to claim 1, wherein said hob comprises an induction hob with an inductively heated heating device, wherein a change in temperature of said cooking vessel is detected from operating parameters for said inductively heated heating device.

4. The method according to claim 1, wherein, in an event of a sudden drop in temperature after triggering of said maintaining function, a temperature is again brought to said previous temperature before said sudden drop in temperature and a time taken until said temperature is again at the previous temperature before said sudden drop in temperature or until said change in temperature is compensated for again is detected.

5. The method according to claim 4, wherein said previously used control variable temperature or power supply is used again directly after detection of said sudden drop in temperature until compensation.

6. The method according to claim 4, wherein said sudden drop in temperature in a case of a time of less than 10 seconds until compensation is evaluated as an introduction of a product to be fried into said cooking vessel, wherein said cooking vessel then continues to be heated with said previous temperature or said temperature which has been reached again being maintained.

7. The method according to claim 4, wherein a sudden, sharp drop in said temperature is evaluated as introduction of water into said cooking vessel, wherein said cooking vessel then continues to be heated with said previous power supply or power or is heated at a customary power for continued boiling of water.

8. The method according to claim 7, wherein said sudden, sharp drop in temperature has a subsequent temperature limiting.

9. The method according to claim 4, wherein, in an event of a sudden change in signal or change in temperature with a change time of less than 5 seconds, a displacement of said cooking vessel is identified, wherein a signal deviation, which is caused by said displacement and not by an actual change in temperature, is not considered to be a control deviation.

10. The method according to claim 9, wherein, in an instance in which a displacement of said cooking vessel is identified, said signal deviation, which is caused by the displacement and not by an actual change in temperature, is not considered to be a control deviation.

11. The method according to claim 1, wherein, in a case of a process with a temperature at said boiling point of water having been identified, said heating device is supplied with a constant power of between 0.5 W/cm$^2$ and 7 W/cm$^2$.

12. The method according to claim 1, wherein, in processes at said boiling point, boiling-dry is identified in an instance in which water no longer covers a pot base and as a result said pot base is warmer than an instance in which it is covered with water and this is suitably indicated to an operator or said power output is reduced or stopped.

13. The method according to claim 1, wherein, during said maintaining process, an operator has an option of adapting or finely adjusting an actual maintaining level once again, wherein, in an instance in which said fine adaptation is performed, said setpoint temperature is adapted in an event of a temperature control operation or a set power density per unit area is adapted in a case of water at said boiling point.

14. The method according to claim 1, wherein an operator can interrupt said maintaining process and can later restart said maintaining process or can select other, power-controlled power densities in the meantime.

15. The method according to claim 1, wherein said measurement variable which is correlated to said cooking vessel temperature is a period duration of said resonant circuit of said cooking point or another variable is derived from this.

16. Said hob is designed to carry out the method according to claim 1.

* * * * *